US009175698B2

(12) United States Patent
Oguma et al.

(10) Patent No.: US 9,175,698 B2
(45) Date of Patent: Nov. 3, 2015

(54) HYDRAULIC CIRCUIT FOR CONSTRUCTION MACHINE

(71) Applicant: KOBELCO CONSTRUCTION MACHINERY CO., LTD., Hiroshima (JP)

(72) Inventors: Shota Oguma, Hiroshima (JP); Koji Ueda, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 346 days.

(21) Appl. No.: 13/719,923

(22) Filed: Dec. 19, 2012

(65) Prior Publication Data

US 2013/0167522 A1 Jul. 4, 2013

(30) Foreign Application Priority Data

Dec. 28, 2011 (JP) ..... 2011-288332

(51) Int. Cl.

| | |
|---|---|
| ***F15B 13/04*** | (2006.01) |
| ***F15B 15/20*** | (2006.01) |
| ***F15B 11/044*** | (2006.01) |
| ***F15B 21/04*** | (2006.01) |
| *F15B 11/024* | (2006.01) |

(52) U.S. Cl.

CPC ..... *F15B 15/202* (2013.01); *F15B 11/044* (2013.01); *F15B 21/047* (2013.01); *F15B 11/024* (2013.01); *F15B 2211/31558* (2013.01); *F15B 2211/327* (2013.01); *F15B 2211/329* (2013.01); *F15B 2211/7053* (2013.01); *F15B 2211/7741* (2013.01); *F15B 2211/785* (2013.01); *F15B 2211/8609* (2013.01)

(58) Field of Classification Search

CPC .... F15B 11/024; F15B 11/044; F15B 15/202; F15B 21/047; F15B 2211/31558; F15B 2211/327; F15B 2211/329; F15B 2211/7053; F15B 2211/7741; F15B 2211/785; F15B 2211/8609

USPC ..... 91/416, 436, 437, 449, 450, 461, 466

See application file for complete search history.

(56) References Cited

U.S. PATENT DOCUMENTS 4,359,931 A * 11/1982 Palmersheim et al. ..... 91/436
5,415,076 A * 5/1995 Krone et al. ..... 91/436

(Continued)

FOREIGN PATENT DOCUMENTS

JP 2001-116006 4/2001
JP 2002-097673 4/2002

(Continued)

OTHER PUBLICATIONS

Office Action issued Aug. 25, 2015 in Japanese Patent Application No. 2011-288332.

*Primary Examiner* — Michael Leslie

(74) *Attorney, Agent, or Firm* — Oblon, McClelland, Maier & Neustadt, L.L.P.

(57) ABSTRACT

A circuit for driving a hydraulic cylinder of a construction machine includes: a hydraulic pump; a tank; a control valve; a bottom side line; a rod side line; a quick return circuit having a branch line branched off from the bottom side line and led to the tank and a quick return valve which allows hydraulic fluid to be flowed through the branch line only when the control valve is switched to a contraction driving position; and a recycling circuit which supplies a part of return fluid discharged from a bottom side fluid chamber to a rod side fluid chamber of the hydraulic cylinder. The recycling circuit allows the hydraulic fluid to be flowed only from the bottom side fluid chamber into the rod side fluid chamber of the hydraulic cylinder only when the hydraulic cylinder is switched to the contraction driving position.

12 Claims, 3 Drawing Sheets

(56) References Cited

U.S. PATENT DOCUMENTS

| | | | | |
|---|---|---|---|---|
| 6,405,633 | B1 * | 6/2002 | Dueckinghaus et al. | 91/436 |
| 7,487,707 | B2 * | 2/2009 | Pfaff et al. | 91/437 |
| 7,913,491 | B2 * | 3/2011 | Lin et al. | 91/436 |
| 8,047,121 | B2 * | 11/2011 | Yamamoto et al. | 91/436 |
| 2009/0007772 | A1 * | 1/2009 | Yamamoto et al. | 91/436 |

FOREIGN PATENT DOCUMENTS

| | | |
|---|---|---|
| JP | 2002-339904 | 11/2002 |
| JP | 2003-074517 | 3/2003 |
| JP | 2004-92247 | 3/2004 |
| JP | 2010-185515 | 8/2010 |
| JP | 2011-149473 | 8/2011 |

* cited by examiner

HYDRAULIC CIRCUIT FOR CONSTRUCTION MACHINE

BACKGROUND OF THE INVENTION

1. Field of the Invention

The present invention relates to a hydraulic circuit for driving a hydraulic cylinder of a construction machine including a working attachment, such as an excavator, for example.

2. Description of the Background Art

Background art relating to the present invention will be described, showing an excavator shown in FIG. 5 as an example. The excavator includes a lower propelling body 1, an upper slewing body 2 mounted on the lower propelling body 1 so as to be free to slew, and a working attachment 3 attached to the upper slewing body 2. The working attachment 3 includes: a boom 4 capable of being raised and lowered; an arm 5 attached to a tip end of the boom 4 rotatably about a horizontal axis extending in a right-left direction; a bucket 6 attached to a tip end of the arm 5 rotatably about the horizontal axis in a right-left direction; a boom cylinder 7 which is a hydraulic cylinder capable of being expanded and contracted so as to drive the boom 4 in a raising direction and a lowering direction; an arm cylinder 8 which is a hydraulic cylinder capable of being expanded and contracted so as to rotate the arm 5 in a pushing direction, that is, a direction away from the upper slewing body 2, and a retracting direction, that is, a direction toward the upper slewing body 2; and a bucket cylinder 9 which is a hydraulic cylinder capable of being expanded and contracted so as to rotate the bucket 6 in respective directions corresponding to an excavating operation and a dumping operation. Each hydraulic cylinder includes a bottom side fluid chamber for receiving a supply of hydraulic fluid to expand the hydraulic cylinder, and a rod side fluid chamber for receiving a supply of hydraulic fluid to contract the hydraulic cylinder.

The excavator further includes a hydraulic circuit for driving each hydraulic cylinder. The hydraulic circuit includes a hydraulic pump, a tank, and a control valve interposed between the hydraulic cylinder and the hydraulic pump and tank. The control valve has selectable positions: a position for allowing hydraulic fluid to be supplied to the bottom side fluid chamber of the hydraulic cylinder and allowing hydraulic fluid in the rod side fluid chamber to be discharged; and a position for allowing hydraulic fluid to be supplied to the rod side fluid chamber and allowing hydraulic fluid in the bottom side fluid chamber to be discharged, thereby enabling the expansion/contraction operations of the hydraulic cylinder to be controlled.

Each hydraulic cylinder has a difference between a sectional area of the bottom side fluid chamber and a sectional area of the rod side fluid chamber, the difference corresponding to a sectional area of a rod of the hydraulic cylinder. This sectional area difference makes a flow rate of the hydraulic fluid returning to the tank, namely return fluid, from the bottom side fluid chamber during a contraction operation of the hydraulic cylinder be greater than that of the hydraulic fluid supplied to the rod side fluid chamber, thereby involving a problem of increasing pressure loss in a return side fluid passage.

In response to this problem, a first conventional technique described in Japanese Patent Application Publication No. 2002-339904 uses a quick return circuit branched off from a bottom side line of the hydraulic cylinder and communicated with the tank bypassing the control valve. The quick return circuit returns a part of the return fluid discharged from the bottom side fluid chamber during the contraction operation of the hydraulic cylinder directly to the tank, thereby reducing the pressure loss in the return side fluid passage.

The quick return circuit, however, reduces a flow rate of the hydraulic fluid returning to the tank via the control valve, thus increasing a possibility of cavitation in a supply side fluid passage particularly when the hydraulic cylinder is operated in an identical direction to a direction in which gravity acts on the attachment itself. Specifically, for example, when the arm cylinder 8 is driven in the arm pushing direction, or in other words the direction for contracting the arm cylinder 8, from such an attitude that the arm 5 is enfolded, as shown in FIG. 5, or in other words an attitude in which the weight of the arm 5 and the bucket 6 acts on the arm cylinder 8 in a direction for contracting the arm cylinder, a back pressure of the arm cylinder 8 is reduced to make a rod side pressure, that is, a supply side pressure, be negative, thereby generating a possibility of cavitation.

Meanwhile, a second conventional technique described in Japanese Patent Application Publication No. 2004-92247 uses a recycling circuit interconnecting a rod side line and the bottom side line for the hydraulic cylinder to prevent cavitation due to a reduction in the pressure in the supply side fluid passage from occurring. The recycling circuit suppresses the reduction in the supply side pressure by recycling a part of the discharge side fluid to return to the supply side bypassing the control valve. However, it is difficult to apply the recycling circuit according to the second conventional technique directly to the first conventional technique for the purpose of prevention of cavitation in the first conventional technique. If the recycling circuit were added to the first conventional technique to return a part of the return fluid from the bottom side fluid passage to the rod side fluid passage, or in other words if the recycling circuit were simply added to a hydraulic circuit including the aforethe quick return circuit, the fluid supplied to the bottom side fluid chamber for moving the hydraulic cylinder in an expansion direction could return to the tank through the quick return circuit or could be flowed into the rod side through the recycling circuit. This hinders the hydraulic circuit from functioning as a circuit for actually driving a hydraulic cylinder.

SUMMARY OF THE INVENTION

An object of the present invention is to provide a hydraulic circuit for driving a hydraulic cylinder installed in a construction machine, the hydraulic circuit being capable of reducing pressure loss at return side upon operation of contracting the hydraulic cylinder, by use of a quick return circuit, while preventing cavitation from occurring due to the use of the quick return circuit. Provided is a hydraulic circuit installed in a construction machine to drive a hydraulic cylinder provided in the construction machine, the hydraulic cylinder including a bottom side fluid chamber and a rod side fluid chamber and adapted to be operated in an expansion direction by a supply of hydraulic fluid to the bottom side fluid chamber while discharging hydraulic fluid from the rod side fluid chamber and to be operated in a contraction direction by a supply of hydraulic fluid to the rod side fluid chamber while discharging hydraulic fluid from the bottom side fluid chamber, the hydraulic circuit comprising: a hydraulic pump for supplying the hydraulic fluid to the hydraulic cylinder; a tank for receiving the hydraulic fluid discharged from the hydraulic cylinder; a control valve operable to be switched between an expansion driving position for leading the hydraulic fluid discharged from the hydraulic pump to the bottom side fluid chamber and leading the hydraulic fluid discharged from the rod side fluid chamber to the tank to thereby operate the hydraulic cylinder in an expansion direction and a contraction driving position for leading the hydraulic fluid discharged from the hydraulic pump to the rod side fluid chamber and leading the hydraulic fluid discharged from the bottom side fluid chamber to the tank to thereby operate the hydraulic cylinder in a contraction direction; a bottom side line connecting the bottom side fluid chamber of the hydraulic cylinder to the control valve; a rod side line connecting the rod side fluid chamber of the hydraulic cylinder to the control valve; a quick return circuit having a branch line branched off from the bottom side line and led to the tank so as to return the hydraulic fluid discharged from the bottom side fluid chamber directly to the tank, that is, return fluid, while bypassing the control valve when the hydraulic cylinder is operated in the contraction direction, and a quick return valve provided in the branch line to allow the hydraulic fluid to be flowed through the branch line only when the control valve is switched to the contraction driving position; and a recycling circuit which supplies a part of the return fluid discharged from the bottom side fluid chamber to the rod side fluid chamber of the hydraulic cylinder, the recycling circuit allowing the hydraulic fluid to be flowed only in one direction from the bottom side fluid chamber to the rod side fluid chamber only when the hydraulic cylinder is switched to the contraction driving position.

DESCRIPTION OF THE PREFERRED EMBODIMENTS

Figure 1:
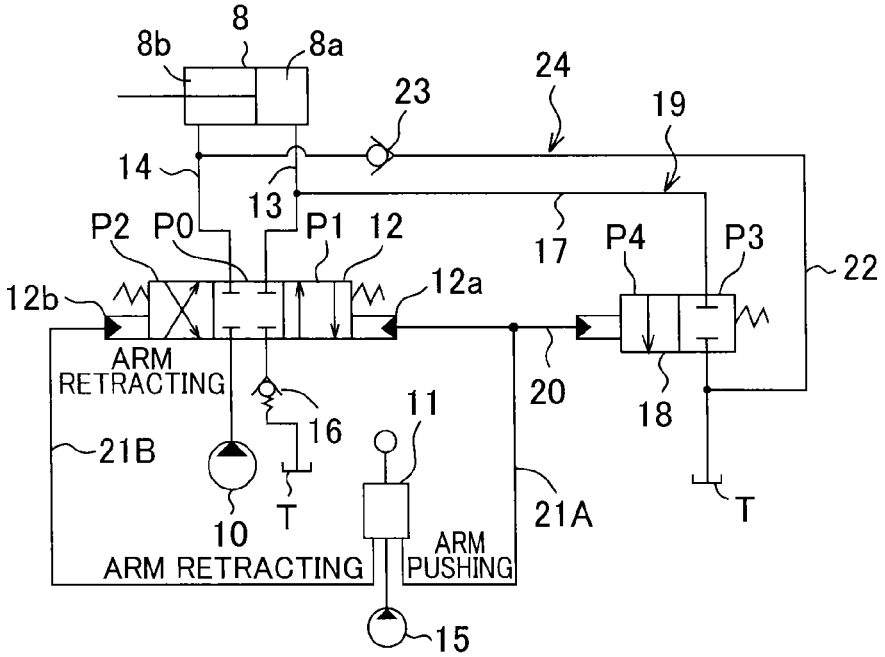
FIG. 1 is a circuit diagram showing a first embodiment of the present invention.

There will be described below first to fourth embodiments of the present invention with reference to FIGS. 1 to 4, respectively. Each of hydraulic circuits according to the embodiments respectively is installed in the excavator shown in FIG. 5 in order to drive the arm cylinder 8 of the excavator. The arm cylinder 8 includes the bottom side fluid chamber 8*a* and the rod side fluid chamber 8*b* and is configured to be operated in an expansion direction while discharging hydraulic fluid from the rod side fluid chamber 8*b*, by a supply of hydraulic fluid to the bottom side fluid chamber 8*a* and to be operated in a contraction direction while discharging hydraulic fluid from the bottom side fluid chamber 8*a*, by a supply of hydraulic fluid to the rod side fluid chamber 8*b*.

The circuit according to each of the first to fourth embodiments shown respectively in FIGS. 1 to 4 includes, as common constituent elements: a hydraulic pump 10 for supplying hydraulic fluid to the arm cylinder 8; a tank T which receives the hydraulic fluid discharged from the arm cylinder 8; a control valve 12 provided between the arm cylinder 8 and each of the hydraulic pump 10 and tank T; a remote control valve 11 corresponding to an operating device for performing an operation to switch a position of the control valve 12; a bottom side line (pipeline) 13 connecting the control valve 12 to the bottom side fluid chamber 8*a* of the arm cylinder 8; a rod side line (pipeline) 14 connecting the control valve 12 to the rod side fluid chamber 8*b* of the arm cylinder 8; a pilot pump 15 serving as a pilot fluid pressure source for the remote control valve 11; and a back pressure valve 16.

The control valve 12 is constituted by a pilot controlled three-position selector valve with a pair of pilot ports 12*a*, 12*b*, having a neutral position P0, an arm pushing position P1 which is a contraction driving position, and an arm retracting position P2 which is an expansion driving position. With switching between these positions, the control valve 12 switches a hydraulic fluid supply/discharge condition with respect to the arm cylinder 8, thereby enable the expansion/contraction operations of the arm cylinder 8 to be controlled. Specifically, when no pilot pressure is supplied to either of the pilot ports 12*a* and 12*b*, the control valve 12 is held in the neutral position P0 to shut off both fluid chambers 8*a*, 8*b* from the hydraulic pump 10 and the tank T. With the supply of pilot pressure to the pilot port 12*b*, the control valve 12 is switched to the arm retracting position P2 to form an fluid passage for introducing hydraulic fluid discharged from the hydraulic pump 10 into the bottom side fluid chamber 8*a* through the bottom side line 13 and leading hydraulic fluid discharged from the rod side fluid chamber 8*b* to the tank T through the rod side line 14, thereby operating the arm cylinder 8 in the expansion direction. Besides, with the supply of pilot pressure to the pilot port 12*a*, the control valve 12 is switched to the arm pushing position P1 to form an fluid passage for introducing the hydraulic fluid discharged from the hydraulic pump 10 to the rod side fluid chamber 8*b* through the rod side line 14 and leading hydraulic fluid discharged from the bottom side fluid chamber 8*a* is led into the tank T through the bottom side line 13, thereby operating the arm cylinder 8 in the contraction direction.

The remote control valve 11 includes an operating lever serving as an operating member and a valve main body to which the operating lever is rotatably connected. The valve main body includes two pilot pressure output ports, namely an arm pushing side port and an arm retracting side port. The arm pushing side port is connected to the pilot port 12*a* via an arm pushing side pilot line 21A, while the arm retracting side port is connected to the pilot port 12*b* via an arm retracting side pilot line 21B. When no operation is applied to the operating lever from a neutral position thereof, the remote control valve 11 outputs no pilot pressure. When an operation to the arm pushing side from the neutral position is applied to the operating lever, the remote control valve 11 outputs pilot pressure of a magnitude corresponding to an operation amount of the operating lever from the arm pushing side port and inputs the pilot pressure into the pilot port 12*a*. When an operation to the arm retracting side from the neutral position is applied to the operating lever, the remote control valve 11 outputs pilot pressure of a magnitude corresponding to the operation amount of the operating lever from the arm retracting side port and inputs the pilot pressure into the pilot port 12*b*.

Next will be described the details of the hydraulic circuit according to the first embodiment shown in FIG. 1.

This hydraulic circuit includes a quick return circuit 19 in addition to the above-mentioned constituent elements, the quick return circuit 19 including a branch line (pipeline) 17 and a quick return valve 18. The branch line 17 is branched off from the bottom side line 13 and led to the tank T while bypassing the control valve 12. The quick return valve 18 is provided in the branch line 17 and adapted to open the branch line 17 so as to allow the return fluid discharged from the bottom side fluid chamber 8*a* to directly return to the tank T while bypassing the control valve 12, only when the control valve 12 is operated to the arm pushing position P1, that is, operated so as to operate the arm cylinder 8 in the contraction direction.

The quick return valve 18 according to this embodiment is constituted by a pilot controlled two-position selector valve with a single pilot port 18*a*. Specifically, the quick return valve 18 is held in a closing position P3 to close the branch line 17 when no pilot pressure is supplied to the pilot port 18*a*, while switched from the closing position P3 to an opening position P4 to open the branch line 17 when pilot pressure is supplied to the pilot port 18*a*.

There is provided a pilot line 20 to introduce the pilot pressure into the pilot port 18*a* of the quick return valve 18. The pilot line 20 branches off from the arm pushing side pilot line 21A to lead the pilot pressure for switching the control valve 12 to the arm pushing position P1 to the pilot port 18*a* only when the operating lever of the remote control valve 11 is applied with the operation to the arm pushing side to input the pilot pressure into the pilot port 12*a* of the control valve 12.

Furthermore, the hydraulic circuit includes a recycling circuit 24 for supplying a part of the return fluid discharged from the bottom side fluid chamber 8*a* to the rod side fluid chamber 8*b*. The recycling circuit 24 includes a bypass line (pipeline) 22 and a check valve 23. The bypass line 22 interconnects the rod side line 14 and a portion of the branch line 17 in the quick return circuit 19, the portion located on an outlet side of the quick return valve 18. The check valve 23, which is provided in the bypass line 22, is a one-way valve which allows fluid to be flowed only in one direction from the branch line 17 toward the rod side line 14.

Thus, in the hydraulic circuit according to the first embodiment, the quick return valve 18 in the quick return circuit 19 doubles a valve which allows the recycling circuit 24 to perform a recycling action only during an arm pushing operation while preventing the recycling circuit 24 from performing the recycling action during an arm retracting operation.

In this hydraulic circuit, upon operation applied to the operating lever serving as the operating member of the remote control valve 11 toward the arm pushing side, that is, the side for contracting the arm cylinder 8, the remote control valve 11 outputs pilot pressure from the arm pushing side port thereof, the pilot pressure being input into the pilot port 12*a* of the control valve 12 to thereby switch the selected position of the control valve 12 from the neutral position P0 to the arm pushing position P1 while being simultaneously input into the pilot port 18*a* of the quick return valve 18 to thereby switch the selected position of the quick return valve 18 from the closing position P3 to the opening position P4. The hydraulic fluid discharged from the hydraulic pump 15 is thereby introduced into the rod side fluid chamber 8*b* of the arm cylinder 8 to operate the arm cylinder 8 in the contraction direction. Meanwhile, the hydraulic fluid in the bottom side fluid chamber 8*a* is returned to the tank T through a first path formed by the bottom side line 13 and the control valve 12 and a second path formed by a part of the bottom side line 13 and the quick return circuit 19, or in other words bypassing the control valve 12. Thus returning a part of the return fluid during the arm pushing operation directly to the tank T bypassing the control valve 12 enables return side pressure loss to be reduced.

Figure 5:
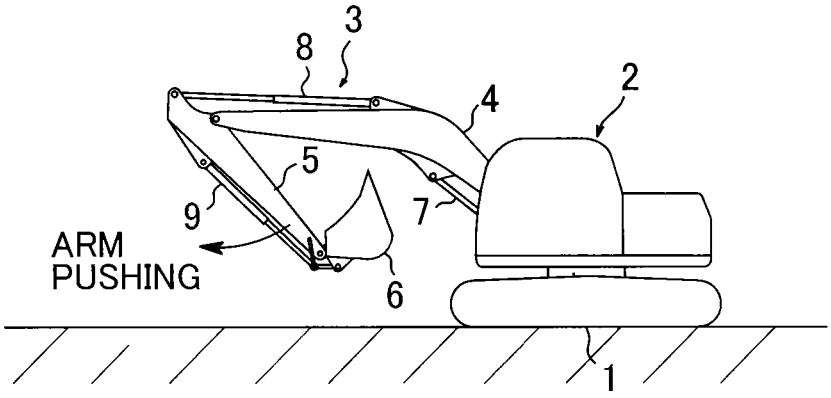
FIG. 5 is a schematic side view of an excavator serving as an example of an application subject of the present invention.

On the other hand, the recycling circuit 24 prevents cavitation from occurring due to the return fluid passing through the second path. Specifically, since a part of the return fluid from the bottom side fluid chamber 8*a*, passing through the second path during the arm pushing operation, reduces a flow rate of the hydraulic fluid returning to the tank T via the control valve 12, by the flow rate of the part of the return fluid, there is a possibility that cavitation is caused by the lowered back pressure and negative pressure at the rod side when the arm pushing operation, that is, the operation for contracting the arm cylinder 8, is performed particularly in an attitude of enfolding the arm 5 as shown in FIG. 5, that is, in such an attitude that the weight of the arm 5 and the bucket 6 acts on the arm cylinder 8 in the direction of contracting the arm cylinder 8; however, the recycling circuit 24 effectively prevents the cavitation. Specifically, the recycling circuit 24 interposed between the rod side line 14 and the portion of the quick return circuit 19, the portion located on the outlet side of the quick return valve 18, allows a part of the hydraulic fluid attempting to return to the tank T through the quick return circuit 19, as described above, to be drawn by the negative pressure on the rod side and thus supplied to the rod side fluid chamber 8*b* during the arm pushing operation. This makes it possible to compensate for the flow rate deficiency in the hydraulic fluid supplied to the rod side fluid chamber 8*b* and thus prevent the cavitation from occurring.

Moreover, the following two inconveniences are also prevented: the first is erroneous return of the hydraulic fluid, which should be supplied to the bottom side fluid chamber 8*a* during the arm retracting operation, to the tank T through the quick return circuit 19; and the second is a flow of the hydraulic fluid into the rod side line 14 through the recycling circuit 24. Specifically, the quick return valve 18 of the quick return circuit 19 allows the hydraulic fluid to be flowed through the branch line 17 only during the arm pushing operation and prevents the hydraulic fluid from being flowed through the branch line 17 during the arm retracting operation, while the check valve 23 of the recycling circuit 24 allows the hydraulic fluid to be flowed only in one direction from the bottom side line 13 into the rod side line 14 only during the arm pushing operation and prevents the hydraulic fluid from being flowed from the rod side line 14 into the bottom side line 13. Thus, both of reducing return side pressure loss and preventing cavitation from occurring on the supply side are achieved while keeping the original function of driving the arm cylinder 8.

Furthermore, in the first embodiment, the quick return valve 18 forming the quick return circuit 19 doubles a part of the recycling circuit 24, that is, the valve for blocking the flow of hydraulic fluid during the arm retracting operation to thereby enable an overall circuit configuration and circuit facilities to be simplified, resulting in reduced cost.

Besides, branching off the pilot line 20 from the arm pushing side pilot line 21A connected to the pilot port 12*a* of the control valve 12 to connect the pilot line 20 to the pilot port 18*a* of the quick return valve 18 allows a pilot line (pipeline) for switching the position of the quick return valve 18 to be simplified and allows the quick return valve 18 to be easily added onto the existing control valve 12.

Next will be described the second embodiment shown in FIG. 2 only about the points in which the second embodiment differs from the first embodiment.

Figure 2:
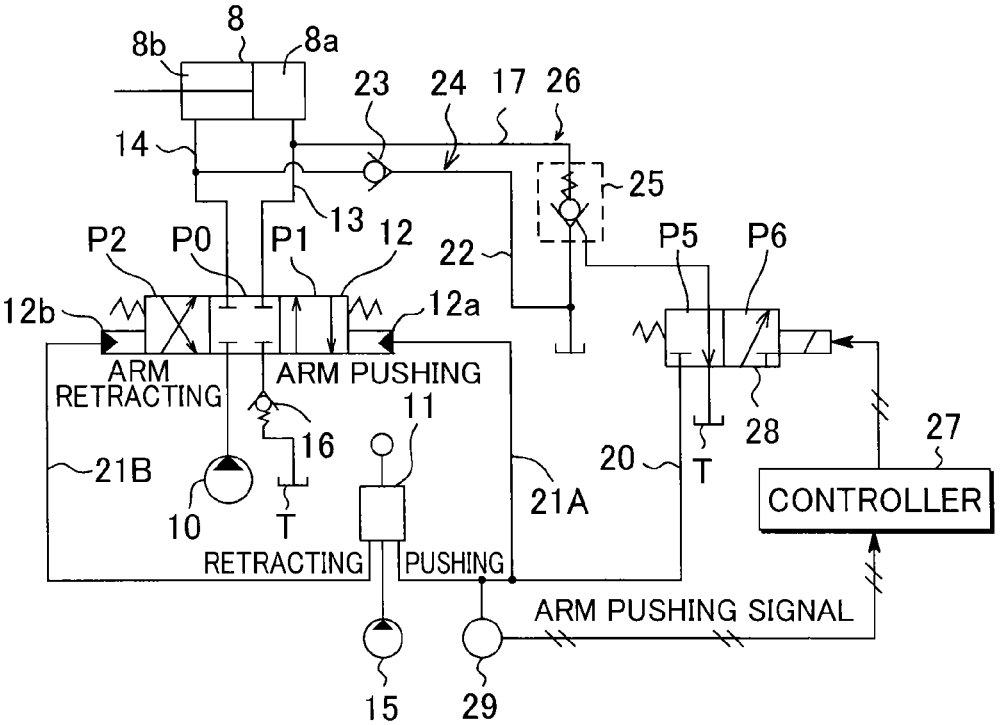
FIG. 2 is a circuit diagram showing a second embodiment of the present invention.

The circuit according to the second embodiment is identical to that of the first embodiment except for the following points.

a) The circuit according to the second embodiment includes a quick return circuit 26 shown in FIG. 2 in place of the quick return circuit 19 described above. The quick return circuit 26 includes the aforethe branch line 17 and a quick return valve 25. The quick return valve 25 is constituted by a pilot controlled check valve. Specifically, the quick return valve 25 is a one-way valve which normally restricts a flow of hydraulic fluid from the bottom side chamber 8*a* to the tank T, but can be opened, by receiving an input of the pilot pressure in an opposite direction thereto, so as to permit the flow when pilot pressure is input therein from.

b) In the circuit according to the second embodiment, there is provided a recycling circuit 24 having a bypass line 22 and a check valve 23 between an outlet side of the quick return valve 25 and the rod side line 14, and the pilot line 20 branched off from the arm pushing side pilot line 21A of the control valve 12 is connected to the quick return valve 25.

The circuit according to the second embodiment further includes a solenoid valve 28, a pressure sensor 29, and a controller 27. The solenoid valve 28 is constituted by a two-position solenoid selector valve and provided midway on the pilot line 20. Specifically, the solenoid valve 28 has a closing position P5 for closing the pilot line 20 and an opening position P6 for opening the pilot line 20, and is adapted to be held is held in the closing position P5 when receiving no input of an electric signal from the controller 27 and to be switched to the opening position P6 when receiving input of an electric signal. The pressure sensor 29 detects the presence and absence of the pilot pressure on the pilot line 20, corresponding to an operation detector for detecting whether the presence and absence of an operation for switching the control valve 12 to the contraction driving position P1. The controller 27, including a control electric circuit, inputs the electric signal into the solenoid valve 28 to switch the solenoid valve 28 from the closing position P5 to the opening position P6 only when the pressure sensor 29 detects the pilot pressure, specifically the pilot pressure input into the pilot port 12*a* of the control valve 12 from the remote control valve 11, or in other words only when the arm pushing operation is detected.

Also in the circuit according to the second embodiment, the pilot pressure is input into the quick return valve 25 only when the arm pushing operation, that is, the operation for contracting the arm cylinder 8, is performed, the input pilot pressure causing the quick return valve 25 to allow the hydraulic fluid to flow from the bottom side line 13 into the rod side line 14; thus basically identical actions and effects to the first embodiment can be obtained.

In the second embodiment, the use of the controller 27 enables the range of controlling the quick return valve 25 to be extended. For example, what can be performed are: a control of opening the quick return valve 25 only when a so-called AND condition is satisfied, the condition being that the return side pressure detected during the arm pushing operation is equals to or greater than a set value; a control of adjusting an opening of the solenoid valve 28 in accordance with a magnitude of the return hydraulic fluid pressure or the arm pushing pilot pressure; and so on.

Besides, the quick return valve 25 according to the second embodiment, similarly to the quick return valve 18 according to the first embodiment, may be directly operated to the opening position side by the arm pushing operation pilot pressure.

Next will be described the third embodiment shown in FIG. 3. The hydraulic circuit according to the third embodiment includes a recycling circuit 32 in place of the recycling circuit 24 according to the first embodiment.

The recycling circuit 32 includes a bypass line 30 and a recycling selector valve 31 provided in the bypass line 30. The bypass line 30 interconnects the bottom side line 13 and the rod side line 14 while bypassing the control valve 12. The recycling selector valve 31 is constituted by a pilot controlled two-position selector valve with a single pilot port 31*a*, having a closing position P7 for closing the bypass line 30 and an opening position P8 for performing a function to allow the hydraulic fluid to flow only in one direction from the bottom side line 13 into the rod side line 14, that is, a function as a check valve. The recycling selector valve 31 is adapted to be held in the closing position P7 when receiving no input of a pilot pressure into the pilot port 31*a*, and to be switched to the opening position P8 when receiving an input of the pilot pressure into the pilot port 31*a*.

To the pilot port 31*a* is connected a pilot line 33 for inputting the pilot pressure into the pilot port 31*a*. The pilot line 33, similarly to the pilot line 20 of the quick return valve 18, is branched off from the arm pushing side pilot line 21 of the control valve 12 and led to the pilot port 31*a* to lead the pilot pressure to the pilot port 31*a* only when the arm pushing operation is performed, thus switching the selected position of the recycling selector valve 31 from the closing position P7 to the opening position P8.

Figure 3:
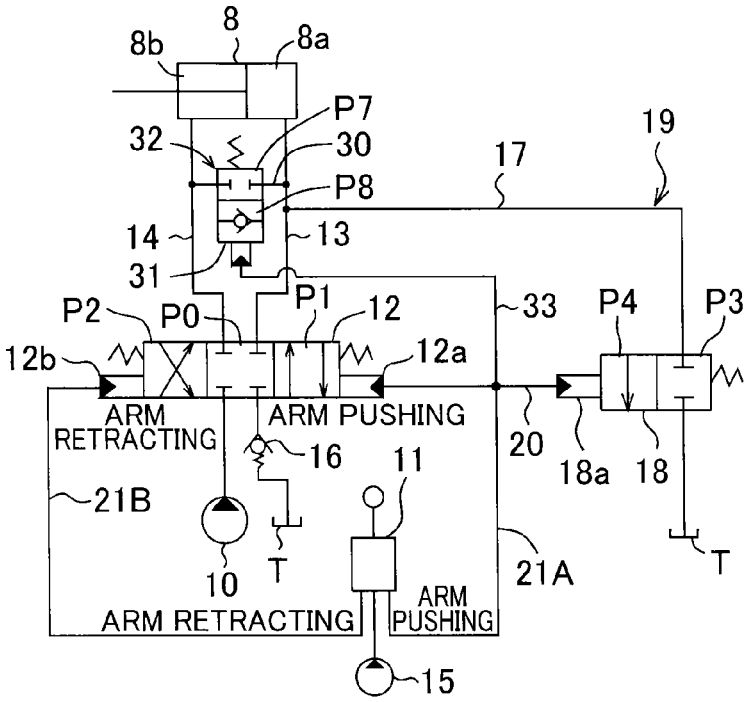
FIG. 3 is a circuit diagram showing a third embodiment of the present invention.

As shown in FIG. 3, the quick return circuit 19 according to the third embodiment is constituted by a branch line 17 and a quick return valve 18 formed of a fluid pressure pilot controlled selector valve, similarly to the quick return circuit 19 according to the first embodiment, while it may be constituted by a branch line 17 and the quick return valve 25 formed from a pilot check valve, similarly to the quick return circuit 26 according to the second embodiment.

Also in the hydraulic circuit according to the third embodiment, since the pilot pressure is input into the recycling selector valve 31 to switch the recycling selector valve 31 to the opening position P8 for allowing the hydraulic fluid to be flowed only from the bottom side line 13 into the rod side line 14 only when the arm pushing operation, that is, the operation for contracting the arm cylinder 8, is performed, it is possible to obtain basically identical actions and effects to the first and second embodiments. Furthermore, the third embodiment allows the recycling circuit 32 to be incorporated compactly between the bottom side and rod side lines 13 and 14; this is advantageous for adding the recycling selector valve 31 onto the control valve.

Figure 4:
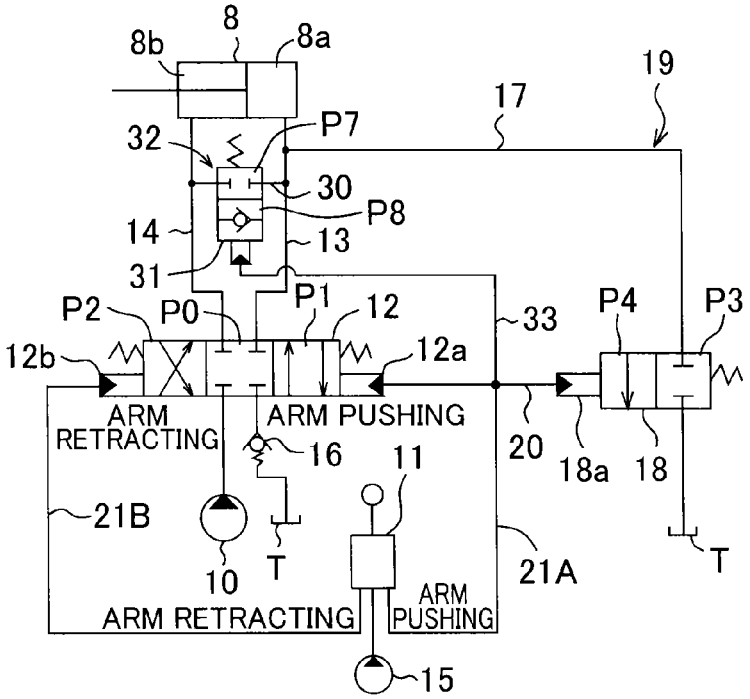
FIG. 4 is a circuit diagram showing a fourth embodiment of the present invention.

The difference between the hydraulic circuit according to the third embodiment and the hydraulic circuit according to the fourth embodiment shown in FIG. 4 is only in the following point: the bypass line 30 according to the fourth embodiment is connected to a portion of the bottom side line 13, the portion located on a downstream side (specifically, a downstream side in a flow direction of the return hydraulic fluid discharged from the bottom side fluid chamber 8*a*) of a branching point at which the branch line 17 is branched off from the bottom side line 13, whereas the bypass line 30 according to the third embodiment is connected to a portion on an upstream side of the branching point. In the hydraulic circuit according to the third embodiment, it is possible to make a pressure at a connection point between the bottom side line 13 and the bypass line 30 be high, in comparison with the hydraulic circuit according to the fourth embodiment, to expand a difference between this pressure and the rod side pressure; this promotes the flow of the hydraulic fluid from the bottom side to the rod side, thereby improving a cavitation prevention effect.

The present invention is not limited to the first to fourth embodiments described above. For example, the hydraulic circuit according to the present invention may be a circuit for driving a bucket cylinder instead of a circuit for driving an arm cylinder, as described above. In the case of applying the present invention to the bucket cylinder 9 shown in FIG. 5, the dumping operation of the bucket 6 corresponds to the contraction operation of the bucket cylinder 9. Besides, the construction machine provided with the hydraulic circuit according to the present invention is not limited to an excavator. For example, the hydraulic circuit according to the present invention may also be used to drive a hydraulic cylinder in a construction machine such as a demolition machine or a crusher constructed by use of a hydraulic excavator as a base, or a construction machine having a different type of working attachment from a working attachment for an excavator.

As described above, the present invention provides a hydraulic circuit for driving a hydraulic cylinder installed in a construction machine, the hydraulic circuit being capable of reducing pressure loss at return side upon operation of contracting the hydraulic cylinder, by use of a quick return circuit, while preventing cavitation from occurring due to the use of the quick return circuit. Provided is a hydraulic circuit installed in a construction machine to drive a hydraulic cylinder provided in the construction machine, the hydraulic cylinder including a bottom side fluid chamber and a rod side fluid chamber and adapted to be operated in an expansion direction by a supply of hydraulic fluid to the bottom side fluid chamber while discharging hydraulic fluid from the rod side fluid chamber and to be operated in a contraction direction by a supply of hydraulic fluid to the rod side fluid chamber while discharging hydraulic fluid from the bottom side fluid chamber, the hydraulic circuit comprising: a hydraulic pump for supplying the hydraulic fluid to the hydraulic cylinder; a tank for receiving the hydraulic fluid discharged from the hydraulic cylinder; a control valve operable to be switched between an expansion driving position for leading the hydraulic fluid discharged from the hydraulic pump to the bottom side fluid chamber and leading the hydraulic fluid discharged from the rod side fluid chamber to the tank to thereby operate the hydraulic cylinder in an expansion direction and a contraction driving position for leading the hydraulic fluid discharged from the hydraulic pump to the rod side fluid chamber and leading the hydraulic fluid discharged from the bottom side fluid chamber to the tank to thereby operate the hydraulic cylinder in a contraction direction; a bottom side line connecting the bottom side fluid chamber of the hydraulic cylinder to the control valve; a rod side line connecting the rod side fluid chamber of the hydraulic cylinder to the control valve; a quick return circuit having a branch line branched off from the bottom side line and led to the tank so as to return the hydraulic fluid discharged from the bottom side fluid chamber directly to the tank while bypassing the control valve when the hydraulic cylinder is operated in the contraction direction, and a quick return valve provided in the branch line to allow the hydraulic fluid to be flowed through the branch line only when the control valve is switched to the contraction driving position; and a recycling circuit which supplies a part of the return fluid discharged from the bottom side fluid chamber to the rod side fluid chamber of the hydraulic cylinder, the recycling circuit allowing the hydraulic fluid to be flowed only in one direction from the bottom side fluid chamber to the rod side fluid chamber only when the hydraulic cylinder is switched to the contraction driving position.

In this hydraulic circuit, the quick return circuit returns back the return fluid discharged from the bottom side fluid chamber directly to the tank bypassing the control valve when the hydraulic cylinder is operated in the contraction direction, thereby enabling pressure loss on the return side to be reduced. Furthermore, the recycle circuit compensates for a deficiency in the flow rate of the hydraulic fluid passing through the rod side fluid passage due to the flow of the hydraulic fluid returned bypassing the control valve, thereby preventing cavitation from occurring. Moreover, the quick return valve of the quick return circuit allows the hydraulic fluid to be flowed through the branch passage only when the control valve is switched to the contraction driving position and blocks the hydraulic fluid flow when the control valve is switched to the expansion driving position, while the recycling circuit allows the hydraulic fluid to be flowed from the bottom side to the rod side and prevents the fluid from being flowed from the rod side to the bottom side, only when the control valve is switched to the contraction driving position; thus, it is prevented that the fluid which should be supplied to the bottom side fluid chamber when the hydraulic cylinder is operated in the expansion direction is returned to the tank through the quick return circuit or flowed to the rod side through the recycling circuit.

In summary, the hydraulic circuit provided by the present invention permits both of reducing return side pressure loss and preventing cavitation from occurring on the supply side to be achieved while securing the original function of driving the hydraulic cylinder.

The quick return valve is preferably a valve operated by a pilot pressure, adapted to be held in a closing position for closing the branch line when receiving no input of the pilot pressure and to be switched to an opening position for opening the branch line when receiving an input of the pilot pressure.

In this case, it is preferable that the hydraulic circuit further comprises an operating device to which an operation for switching a position of the control valve is applied, the operating device adapted to output a pilot pressure corresponding to the applied operation, and a pilot line which introduces a pilot pressure for switching the control valve to the contraction driving position, the pilot pressure output from the operating device, into the quick return valve as the pilot pressure for the quick return valve; this eliminates a need for a dedicated fluid pressure supply to switch the quick return valve. Besides, the pilot line only has to be connected to a pilot line used for the contraction driving operation of the control valve, which permits the pilot line (pipeline) for operating the quick return valve to be simplified and the quick return valve to be easily added onto the control valve.

Besides, it is also preferable that the hydraulic circuit further comprises a solenoid valve provided in the pilot line of the quick return valve and switched by an electric signal between a closing position for closing the pilot line and an opening position for opening the pilot line, an operation detector which detects an operation of the control valve to the contraction driving position, and a controller which inputs an electric signal into the solenoid valve to switch the solenoid valve to the opening position when the operation detector detects the operation to the contraction driving position; this allows the range of the control of the quick return valve to be extended.

As the quick return valve which is switched, as described above, from the closing position to the opening position when the pilot pressure is input, preferable is a pilot controlled selector valve having a pilot port and being adapted to be switched to the opening position when the pilot pressure is input into the pilot port, or a pilot check valve which is a one-way valve restricting a flow in a direction from the bottom side fluid chamber into the tank and is opened so as to allow the flow only when the pilot pressure is input therein.

On the other hand, as the recycling circuit, preferable is one including: a bypass line connecting the rod side line to a portion of the branch line, the portion located on an outlet side of the quick return valve; and a check valve provided in the bypass line to allow the hydraulic fluid to be flowed only from the bottom side line into the rod side line. In the recycling circuit, the quick return valve doubles a part of the recycling circuit, that is, a valve for blocking the flow of the hydraulic fluid for driving the hydraulic cylinder in the expansion direction, thereby enabling the overall circuit configuration and circuit facilities of the hydraulic cylinder to be simplified, resulting in reduced cost.

Alternatively, it is also preferable the recycling circuit includes: a bypass line connecting the bottom side line to the rod side line; and a recycling selector valve provided in the bypass line and adapted to be switched between a closing position for closing the bypass line and an opening position for performing a function as a check valve which allows the hydraulic fluid to be flowed only in a direction from the bottom side line into the rod side line only when operating the hydraulic cylinder in the contraction direction. The recycling circuit can be incorporated compactly between the bottom side line and the rod side line, being advantageous particularly in the case of adding the recycling selector valve onto the control valve.

In this case, the bypass line is preferably connected to a portion of the bottom side line on an upstream side of a branching point at which the branch line is branched off from the bottom side line in a flow direction of the return fluid discharged from the bottom side fluid chamber. This configuration enables the pressure at the connection point to be increased to widen the difference between this pressure and the rod side pressure, in comparison with the case of the bypass line connected to the bottom side line in a position on the downstream side of the branching point. This makes it possible to promote the flow of the hydraulic fluid from the bottom side line into the rod side line, thereby improving the cavitation prevention effect.

This application is based on Japanese Patent application No. 2011-288332 filed in Japan Patent Office on Dec. 28, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A hydraulic circuit installed in a construction machine to drive a hydraulic cylinder provided in the construction machine, the hydraulic cylinder including a bottom side fluid chamber and a rod side fluid chamber and adapted to be operated in an expansion direction by a supply of hydraulic fluid to the bottom side fluid chamber while discharging hydraulic fluid from the rod side fluid chamber and to be operated in a contraction direction by a supply of hydraulic fluid to the rod side fluid chamber while discharging hydraulic fluid from the bottom side fluid chamber, the hydraulic circuit comprising:

a hydraulic pump for supplying the hydraulic fluid to the hydraulic cylinder;

a tank for receiving the hydraulic fluid discharged from the hydraulic cylinder;

a control valve operable to be switched between an expansion driving position for leading the hydraulic fluid discharged from the hydraulic pump to the bottom side fluid chamber and leading the hydraulic fluid discharged from the rod side fluid chamber to the tank to thereby operate the hydraulic cylinder in the expansion direction and a contraction driving position for leading the hydraulic fluid discharged from the hydraulic pump to the rod side fluid chamber and leading the hydraulic fluid discharged from the bottom side fluid chamber to the tank to thereby operate the hydraulic cylinder in the contraction direction;

a bottom side line connecting the bottom side fluid chamber of the hydraulic cylinder to the control valve;

a rod side line connecting the rod side fluid chamber of the hydraulic cylinder to the control valve;

a quick return circuit having a branch line branched off from the bottom side line and led to the tank so as to return the hydraulic fluid discharged from the bottom side fluid chamber directly to the tank while bypassing the control valve when the hydraulic cylinder is operated in the contraction direction, and a quick return valve provided in the branch line to allow the hydraulic fluid to be flowed through the branch line only when the control valve is switched to the contraction driving position; and a recycling circuit which supplies a part of the return fluid discharged from the bottom side fluid chamber to the rod side fluid chamber of the hydraulic cylinder, the recycling circuit allowing the hydraulic fluid to be flowed only in one direction from the bottom side fluid chamber to the rod side fluid chamber only when the control valve is switched to the contraction driving position, wherein the recycling circuit includes a bypass line connecting the rod side line to a portion of the branch line, the portion located on an outlet side of the quick return valve, and a check valve provided in the bypass line to allow the hydraulic fluid to be flowed only from the bottom side line into the rod side line.

2. The hydraulic circuit for a construction machine according to claim 1, wherein the quick return valve is a valve which is operated by a pilot pressure and adapted to be held in a closing position for closing the branch line when receiving no input of the pilot pressure and to be switched to an opening position for opening the branch line when receiving an input of the pilot pressure.

3. The hydraulic circuit for a construction machine according to claim 2, further comprising:

an operating device to which an operation for switching a position of the control valve is applied, the operating device adapted to output a pilot pressure corresponding to the applied operation; and a pilot line which introduces a pilot pressure for switching the control valve to the contraction driving position, the pilot pressure being output from the operating device, into the quick return valve as the pilot pressure for the quick return valve.

4. The hydraulic circuit for a construction machine according to claim 2, further comprising:

a solenoid valve provided in the pilot line of the quick return valve and switched by an electric signal between a closing position for closing the pilot line and an opening position for opening the pilot line;

an operation detector which detects an operation of the control valve to the contraction driving position; and a controller which inputs an electric signal into the solenoid valve to switch the solenoid valve to the opening position when the operation detector detects the operation to the contraction driving position.

5. The hydraulic circuit for a construction machine according to claim 2, wherein the quick return valve is constituted by a pilot controlled selector valve having a pilot port and being adapted to be switched to the opening position when the pilot pressure is input into the pilot port.

6. The hydraulic circuit for a construction machine according to claim 2, wherein the quick return valve is a pilot controlled check valve which is a one-way valve restricting a flow of the hydraulic fluid from the bottom side fluid chamber into the tank and being operable to be opened so as to allow the flow only when receiving an input of the pilot pressure.

7. A hydraulic circuit installed in a construction machine to drive a hydraulic cylinder provided in the construction machine, the hydraulic cylinder including a bottom side fluid chamber and a rod side fluid chamber and adapted to be operated in an expansion direction by a supply of hydraulic fluid to the bottom side fluid chamber while discharging hydraulic fluid from the rod side fluid chamber and to be operated in a contraction direction by a supply of hydraulic fluid to the rod side fluid chamber while discharging hydraulic fluid from the bottom side fluid chamber, the hydraulic circuit comprising:

a hydraulic pump for supplying the hydraulic fluid to the hydraulic cylinder;

a tank for receiving the hydraulic fluid discharged from the hydraulic cylinder;

a control valve operable to be switched between an expansion driving position for leading the hydraulic fluid discharged from the hydraulic pump to the bottom side fluid chamber and leading the hydraulic fluid discharged from the rod side fluid chamber to the tank to thereby operate the hydraulic cylinder in the expansion direction and a contraction driving position for leading the hydraulic fluid discharged from the hydraulic pump to the rod side fluid chamber and leading the hydraulic fluid discharged from the bottom side fluid chamber to the tank to thereby operate the hydraulic cylinder in the contraction direction;

a bottom side line connecting the bottom side fluid chamber of the hydraulic cylinder to the control valve;

a rod side line connecting the rod side fluid chamber of the hydraulic cylinder to the control valve;

a quick return circuit having a branch line branched off from the bottom side line and led to the tank so as to return the hydraulic fluid discharged from the bottom side fluid chamber directly to the tank while bypassing the control valve when the hydraulic cylinder is operated in the contraction direction, and a quick return valve provided in the branch line to allow the hydraulic fluid to be flowed through the branch line only when the control valve is switched to the contraction driving position; and a recycling circuit which supplies a part of the return fluid discharged from the bottom side fluid chamber to the rod side fluid chamber of the hydraulic cylinder, the recycling circuit allowing the hydraulic fluid to be flowed only in one direction from the bottom side fluid chamber to the rod side fluid chamber only when the control valve is switched to the contraction driving position, wherein the recycling circuit comprises: a bypass line connecting the bottom side line to the rod side line; and a recycling selector valve provided in the bypass line and adapted to be switched between a closing position for closing the bypass line and an opening position for performing a function as a check valve which allows the hydraulic fluid to be flowed only in one direction from the bottom side line into the rod side line only when operating the hydraulic cylinder in the contraction direction, wherein the bypass line is connected to a portion of the bottom side line, the portion located on an upstream side of a branching point at which the branch line is branched off from the bottom side line in a flow direction of the return fluid discharged from the bottom side fluid chamber.

8. The hydraulic circuit for a construction machine according to claim 7, wherein the quick return valve is a valve which is operated by a pilot pressure and adapted to be held in a closing position for closing the branch line when receiving no input of the pilot pressure and to be switched to an opening position for opening the branch line when receiving an input of the pilot pressure.

9. The hydraulic circuit for a construction machine according to claim 8, further comprising:

an operating device to which an operation for switching a position of the control valve is applied, the operating device adapted to output a pilot pressure corresponding to the applied operation; and a pilot line which introduces a pilot pressure for switching the control valve to the contraction driving position, the pilot pressure being output from the operating device, into the quick return valve as the pilot pressure for the quick return valve.

10. The hydraulic circuit for a construction machine according to claim 8, further comprising:

a solenoid valve provided in the a pilot line of the quick return valve and switched by an electric signal between a closing position for closing the pilot line and an opening position for opening the pilot line;

an operation detector which detects an operation of the control valve to the contraction driving position; and a controller which inputs an electric signal into the solenoid valve to switch the solenoid valve to the opening position when the operation detector detects the operation to the contraction driving position.

11. The hydraulic circuit for a construction machine according to claim 8, wherein the quick return valve is constituted by a pilot controlled selector valve having a pilot port and being adapted to be switched to the opening position when the pilot pressure is input into the pilot port.

12. The hydraulic circuit for a construction machine according to claim 8, wherein the quick return valve is a pilot controlled check valve which is a one-way valve restricting a flow of the hydraulic fluid from the bottom side fluid chamber into the tank and being operable to be opened so as to allow the flow only when receiving an input of the pilot pressure.

* * * * *